US006935811B2

(12) United States Patent
Simmons et al.

(10) Patent No.: US 6,935,811 B2
(45) Date of Patent: Aug. 30, 2005

(54) FRICTIONAL MINING BOLT

(75) Inventors: Walter Neal Simmons, Durham, NC (US); Walter John Simmons, Martinsburg, WV (US)

(73) Assignee: Terrasimco Inc., Martinsburg, WV (US)

( * ) Notice: Subject to any disclaimer, the term of this patent is extended or adjusted under 35 U.S.C. 154(b) by 0 days.

(21) Appl. No.: 10/292,637

(22) Filed: Nov. 13, 2002

(65) Prior Publication Data

US 2004/0091323 A1 May 13, 2004

(51) Int. Cl.[7] ..... E21D 21/00; E21D 20/00

(52) U.S. Cl. ..... 405/259.3; 411/45; 411/69; 411/70

(58) Field of Search ..... 405/259.1, 259.3; 411/43, 44, 45, 49, 50, 51, 52, 53, 69, 70

(56) References Cited

U.S. PATENT DOCUMENTS

| | | | | |
|---|---|---|---|---|
| 2,804,797 A | * | 9/1957 | Seely | 411/61 |
| 4,126,004 A | | 11/1978 | Lindeboom | |
| 4,195,952 A | * | 4/1980 | Swanson | 405/259.3 |
| 4,284,379 A | | 8/1981 | Chaiko | |

(Continued)

FOREIGN PATENT DOCUMENTS

| | | |
|---|---|---|
| AU | B-42384/85 | 11/1985 |
| AU | A-68705/94 | 2/1995 |
| AU | 749411 | 12/1999 |
| AU | 747261 | 3/2001 |
| CA | 1 171 310 | 7/1984 |
| CH | 564 654 | 7/1975 |
| DE | 27 41 092 A1 | 3/1979 |
| DE | 100 57 041 A1 | 5/2002 |
| EP | 0 179 836 B1 | 1/1989 |
| EP | 0 375 605 B1 | 2/1992 |
| EP | 0 660 003 B1 | 1/1998 |
| GB | 1 413 263 | 12/1975 |
| GB | 2 153 472 A | 8/1985 |
| GB | 2 153 475 A | 8/1985 |
| GB | 2 224 550 B | 5/1990 |
| GB | 2 234 568 B | 2/1991 |
| GB | 2 304 166 B | 3/1997 |
| JP | 10-140998 | 5/1998 |
| NZ | 506394 | 10/2000 |
| SU | 651136 | 3/1979 |
| SU | 1548457 A1 | 3/1990 |
| WO | WO 89/12758 | 12/1989 |
| WO | WO 89/06322 | 5/1990 |
| WO | WO 00/70232 | 11/2000 |

(Continued)

*Primary Examiner*—Sunil Singh
(74) *Attorney, Agent, or Firm*—Steptoe & Johnson LLP

(57) ABSTRACT

A system for mine roof reinforcement includes a bearing plate and a tubular member with an inner surface, an outer surface, first and second free ends, and an enlarged portion disposed proximate one of the free ends. The system also includes a projectile and an insertion member for being received in the tubular member. In addition, a method for inserting a bolt in rock includes: forming a borehole in rock; placing a bearing plate with an opening therein against the rock so that the opening is aligned with the borehole; disposing a tubular member in the borehole and opening so that an enlarged end of the tubular member abuts the plate; and mechanically expanding the tubular member so that an outer wall thereof frictionally engages the rock.

48 Claims, 6 Drawing Sheets

U.S. PATENT DOCUMENTS

| | | | | | |
|---|---|---|---|---|---|
| 4,289,426 | A | | 9/1981 | Chaiko | |
| 4,300,859 | A | * | 11/1981 | Donan, Jr. | 405/259.3 |
| 4,302,131 | A | | 11/1981 | Brown | 405/260 |
| 4,312,604 | A | | 1/1982 | Fu et al. | 405/259 |
| 4,382,719 | A | | 5/1983 | Scott | 405/259 |
| 4,459,067 | A | | 7/1984 | Skogberg et al. | |
| 4,490,074 | A | | 12/1984 | Chaiko | 405/259 |
| 4,502,818 | A | | 3/1985 | Elders | 405/259 |
| 4,511,289 | A | | 4/1985 | Herron | |
| 4,696,606 | A | * | 9/1987 | Herron | 405/259.3 |
| RE32,645 | E | | 4/1988 | Scott | 405/259 |
| 4,768,900 | A | | 9/1988 | Burland | 405/244 |
| 4,906,149 | A | | 3/1990 | Rockenfeller et al. | 411/54 |
| 4,963,062 | A | * | 10/1990 | Giannuzzi | 411/45 |
| 5,017,067 | A | * | 5/1991 | Ohlin | 411/45 |
| 5,033,909 | A | | 7/1991 | McCartney | 405/261 |
| 5,033,911 | A | | 7/1991 | Grbavac | 405/261 |
| 5,044,851 | A | | 9/1991 | Gschwend | 411/44 |
| 5,076,733 | A | * | 12/1991 | Frease | 405/259.1 |
| 5,112,160 | A | * | 5/1992 | Jensen et al. | 405/259.5 |
| 5,114,279 | A | | 5/1992 | Bjerngren et al. | |
| 5,116,176 | A | * | 5/1992 | Yousuke | 411/65 |
| 5,137,395 | A | | 8/1992 | McCartney | 405/259.3 |
| 5,314,268 | A | * | 5/1994 | Calandra et al. | 405/259.5 |
| 5,582,057 | A | | 12/1996 | Litscher | 72/325 |
| 5,586,839 | A | | 12/1996 | Gillespie | 405/259.1 |
| 5,721,047 | A | * | 2/1998 | Thicthener et al. | 405/259.1 |
| 5,765,969 | A | | 6/1998 | Káreby et al. | |
| 5,931,619 | A | | 8/1999 | Hartmann | 411/60 |
| 5,984,562 | A | * | 11/1999 | Brandenstein et al. | 411/44 |
| 5,997,219 | A | | 12/1999 | Krzysztalowicz et al. | |
| 6,048,147 | A | * | 4/2000 | Arisaka et al. | 411/48 |
| 6,048,149 | A | * | 4/2000 | Garcia | 411/69 X |
| 2002/0076298 | A1 | | 6/2002 | Gauthier | 411/57.1 |
| 2002/0081160 | A1 | | 6/2002 | Mocivnik et al. | 405/259.4 |

* cited by examiner

FRICTIONAL MINING BOLT

FIELD OF THE INVENTION

The invention is related to a mining bolt and methods of use thereof. In particular, the invention is related to a frictional system for mine roof reinforcement.

BACKGROUND OF THE INVENTION

It is a well established practice in underground mining work, such as coal mining, tunnel excavation, or the like, to reinforce the roof of the mine to prevent its collapse. There are various types of reinforcement apparatus, the most common are of the mining bolt type. Various designs of ming bolts are known.

Split-Set® by Ingersoll-Rand is a mining bolt which is comprised of a c-shaped metal member which is forced into a bore hole and supports the rock by friction. The hollow shape of the Split-Set® bolt allows the bolt to deform rather than break when a rock shift occurs.

Swellex® by Atlas Copco, Inc. of Sweden is a hollow folded c-shaped tube which hydrostatically expands in the bore hole by means of high pressure water. During the swelling process, the Swellex® bolt adapts to fit the irregularities of the bore hole. The hollow shape allows the tube to deform during rock shifts. Unfortunately, the complex shape of the Swellex® mining bolt is expensive to manufacture. Further, the necessary high pressure water tools and fittings add to the expense and complexity of the method.

Spin-Lock® by Williams Co. discloses a rock bolt which has a hollow interior and has open ends for allowing grout to be pumped therethrough. No resin cartridges are disclosed.

Despite these developments, there exists a need for improved mining bolts and methods of use thereof.

SUMMARY OF THE INVENTION

The invention relates to a method for inserting a bolt in rock including: forming a borehole in rock; placing a bearing plate with an opening therein against the rock so that the opening is aligned with the borehole; disposing a tubular member in the borehole and opening so that an enlarged end of the tubular member abuts the plate; and mechanically expanding the tubular member so that an outer wall thereof frictionally engages the rock. The tubular member may have a modulus of elasticity that is greater than a bulk modulus of elasticity of the rock. The method may further include: removing the projectile from the tubular member after expansion thereof. The method may also include one or more of: placing the tubular member in axial tension when the outer wall thereof frictionally engages the rock; disposing a projectile proximate the enlarged end of the tubular member; contacting the projectile with an insertion member; inserting the insertion member into the tubular member to force the projectile into the tubular member; forcing the projectile proximate a free end of the tubular member opposite the enlarged end; and removing the insertion member from the tubular member. In some embodiments, the method additionally may include one or more of: lubricating at least one of the projectile and internal wall of the tubular member; closing the enlarged end of the tubular member; and mechanically coupling the tubular member to the rock.

The tubular member may frictionally engage the rock with an interfacial anchorage strength of between 100 psi and 1000 psi, and may engage the rock with an anchorage strength of between 200 psi and 1000 psi. The tubular member may be mechanically expanded by forcing a projectile against an internal wall of the tubular member. A force of less than 20,000 pounds may be exerted on the projectile to force the projectile to travel in the tubular member, and the force may be between 3,000 pounds and 15,000 pounds. In some embodiments, a force of between 4,000 pounds and 10,000 pounds is exerted on the projectile to force the projectile to travel in the tubular member.

The projectile may be generally spherical in shape, or may have a generally tapered head portion and a generally elongated body portion. The borehole may have a first length and the tubular member may be disposed in a portion of the first length. The tubular member may be mechanically coupled to the rock, for example, by forcing a protruding portion of the tubular member into the rock and/or by a deformable layer disposed on the outer wall. The deformable layer may include sprayed metal and/or a polymer.

A clearance of between 0 inch and 0.2 inch may be formed between the tubular member and borehole prior to expansion of the tubular member. In some embodiments, a clearance of between 0.01 inch and 0.1 inch is formed between the tubular member and borehole prior to expansion of the tubular member.

The invention further relates to a system for mine roof reinforcement including a bearing plate and a tubular member with an inner surface, an outer surface, first and second free ends, and an enlarged portion disposed proximate one of the free ends. The system also includes a projectile and an insertion member for being received in the tubular member. The projectile may be generally spherical. In some embodiments, the projectile and insertion member are integrally formed. The projectile may be generally tapered and the insertion member may be generally elongated. The inner surface of the tubular member may define a first inner diameter or contour that is smaller than an outer diameter of the projectile. The tubular member may be formed of steel.

The outer surface of the tubular member may be textured, may have protrusions thereon, and may be coated with a polymer, elastomer, and/or roughening agent. A fiber-reinforced polymer may be disposed on the outer surface of the tubular member.

At least one of the projectile and the inner surface of the tubular member may be coated with a lubricant. In some embodiments, a lubricant is impregnated in the projectile.

The projectile may have a diameter between about 0.75 inch and 1.5 inch, and in some embodiments the projectile may have a diameter between about 1 inch and 1.375 inch. The inner diameter of the tubular member may be between 70 and 97 percent of the outer diameter of the projectile. In some embodiments the inner diameter of the tubular member is between 85 and 97 percent of the outer diameter of the projectile, and the inner diameter of the tubular member may be between 90 and 97 percent of the outer diameter of the projectile.

The tubular member may have a substantially uniform outer diameter. The outer surface of the tubular member may have a substantially circular cross-section. The tubular member may have at least one generally linear projection extending along the inner surface between the free ends. The at least one projection may be a weld line.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

Figure 1:
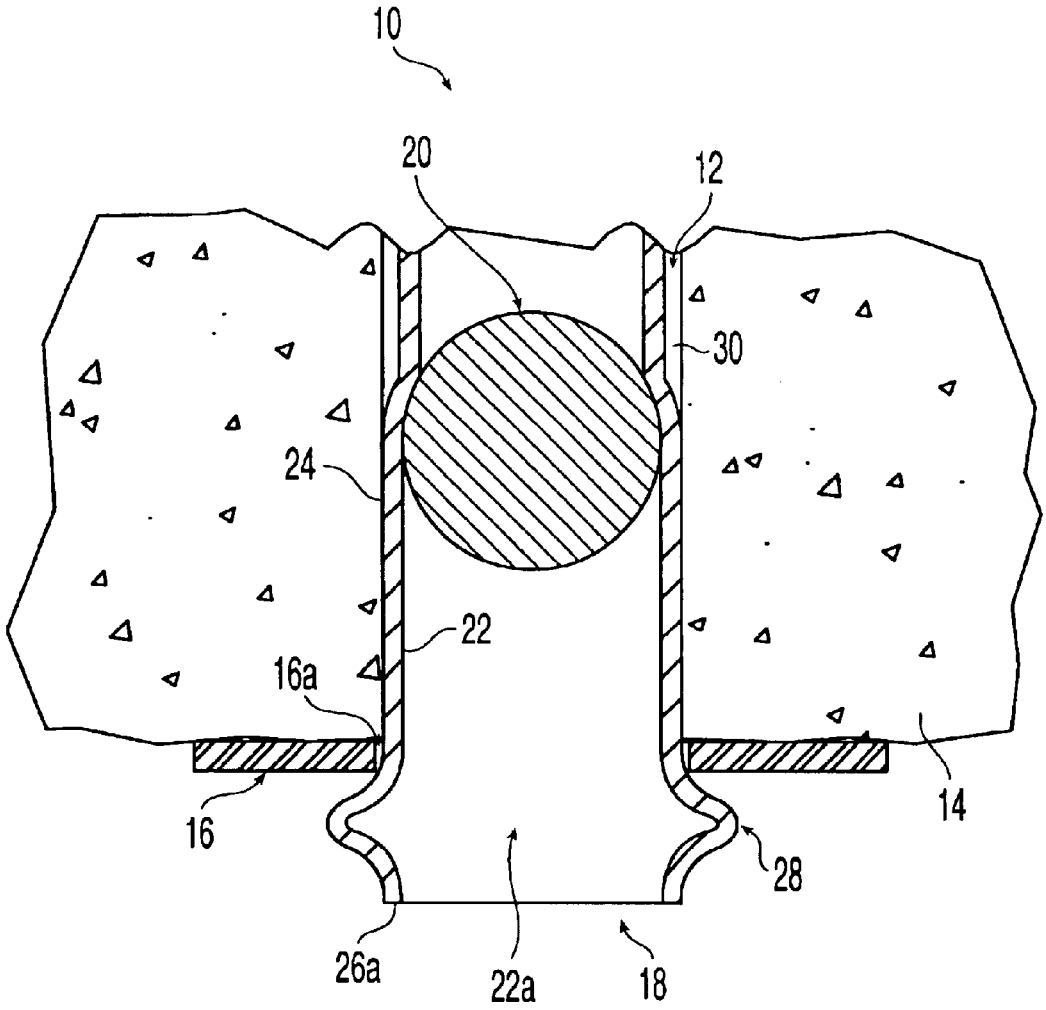
FIG. 1 shows a cross-sectional side view of an exemplary system for mine roof reinforcement according to the present invention, partially secured in a borehole in rock.

Referring to FIG. 1, there is shown an exemplary system 10 for mine roof reinforcement according to the present invention, partially secured in a borehole 12 in rock 14. System 10 includes bearing plate 16 with an opening 16*a*, tubular member 18, and projectile 20. Tubular member 18 has an inner surface 22 defining an opening 22*a*, outer surface 24 and a first free end 26*a*. An enlarged portion 28 is disposed proximate free end 26. Prior to travel of projectile 20 in tubular member 18, a clearance or gap 30 preferably is disposed between tubular member 18 and rock 14. After travel of projectile 20, tubular member 18 is deformed such that clearance 30 is decreased. Preferably, enlarged portion 28 is integrally formed in tubular member 18, and is circumferentially disposed about tubular member 18. In some embodiments, an increase in the inner diameter of tubular member 18 is realized proximate enlarged portion 28. However, in alternate embodiments, enlarged portion 28 comprises a circumferential protrusion, or a flange that may form free end 26*a*. In addition, enlarged portion 28 need not extend about the entire circumference of tubular member 18, but may comprise one or more projections for abutting bearing plate 16.

Tubular member 18 preferably is formed of tube having a modulus of elasticity that is greater than a bulk modulus of elasticity of rock 14. In the preferred embodiment, tubular member 18 is formed of steel (welded or seamless), however in alternate embodiments tubular member 18 is formed of other metallic materials such as aluminum or other alloys, polymer, or another deformable material. Tubular member 18 may also include one or more layers of a deformable material on outer surface 24 such as sprayed metal and/or polymer. An elastomer coating, for example, may be applied. One or both of surfaces 22, 24 may include a protective coating such as paint for corrosion resistance. Tubular member 18 may have a substantially uniform outer diameter and outer surface 24 may have a substantially circular cross-section. In alternate embodiments, at least one of inner surface 22 and outer surface 24 may have a non-circular cross-section, such as hexagonal, square, oval or otherwise oblong.

In some embodiments, tubular member 18 is provided with one or more portions for mechanically coupling tubular member 18 to rock 14 to increase the interfacial strength between outer surface 24 and rock strata 14. For example, outer surface 24 may be provided with texturing such as one or more helical, circumferential, or longitudinal grooves, a raised or depressed waffle pattern, dimples, a raised weld for example in a spiral pattern, or combinations thereof. The raised weld instead may form at least one generally linear projection extending along the inner and/or outer surfaces 22, 24, respectively, between free ends 26*a*, 26*b*. Protrusions may also be formed on outer surface 24 such as small weld spatters for example in the form of raised hemispheres. In yet another alternate embodiment, portions of tubular member 18 may be pierced or otherwise punched through, so that some of outer surface 24 extends outward for locking into rock 14. Surface roughening may also be in the form of holes drilled into the wall of tubular member 18. Various surface treatments may be used to roughen outer surface 24, such as shot peening or other deformation techniques. In addition, outer surface 24 may be painted or otherwise coated with a roughening agent such as a polymer coating that includes glass beads, sand, or metal particles. A polymer reinforced with glass fiber, for example formed with polyesters, may be disposed on outer surface 24.

Figure 1A:
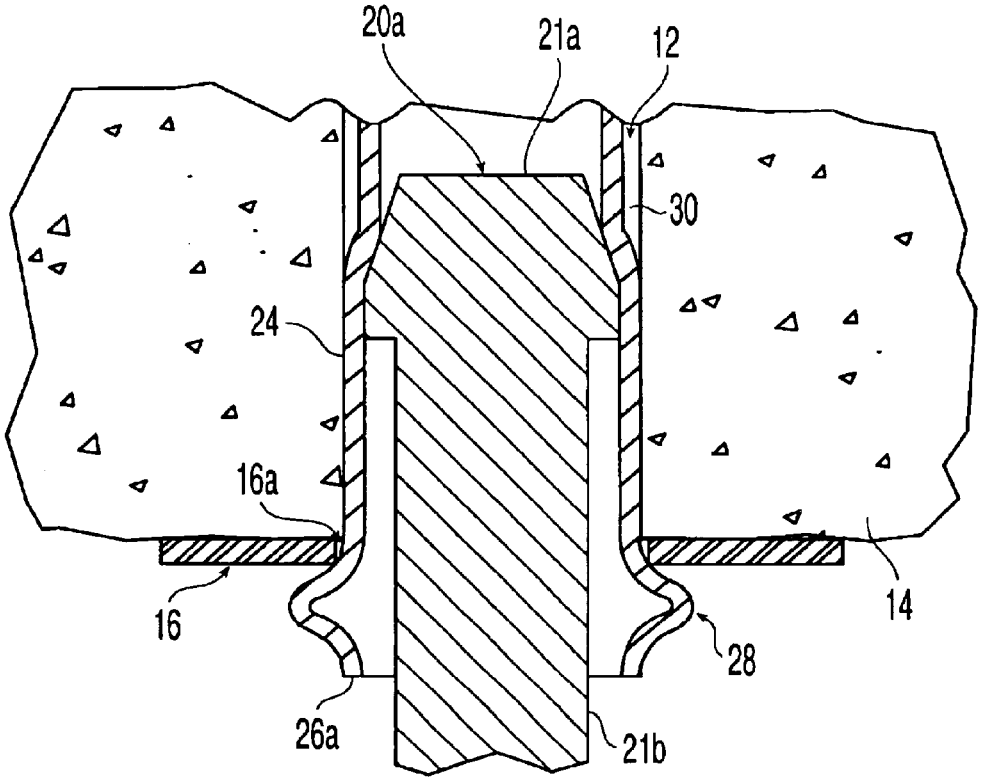
FIG. 1A shows a cross-sectional side view of the exemplary system of FIG. 1 with an alternate projectile.
Figure 1B:
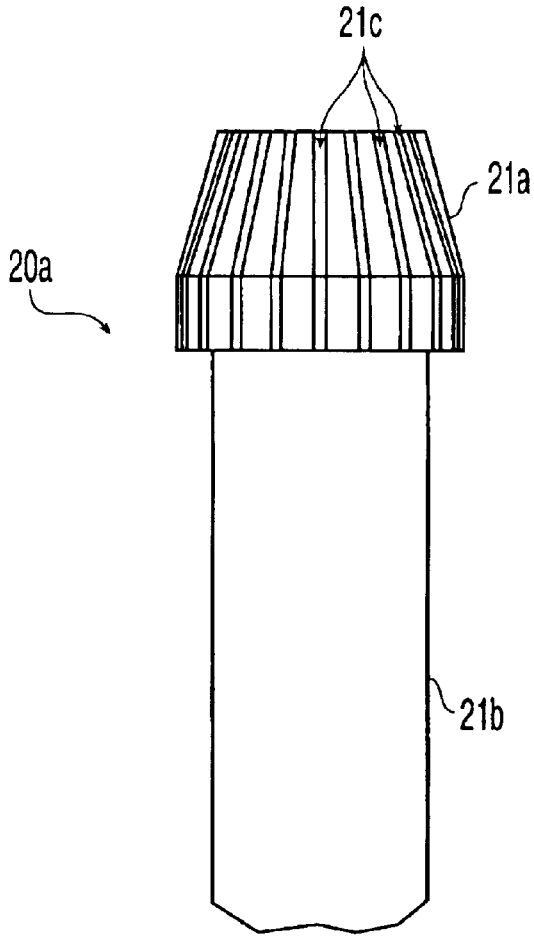
FIG. 1B shows a side view of another alternate projectile for use with the exemplary system of FIG. 1.
Figure 1C:
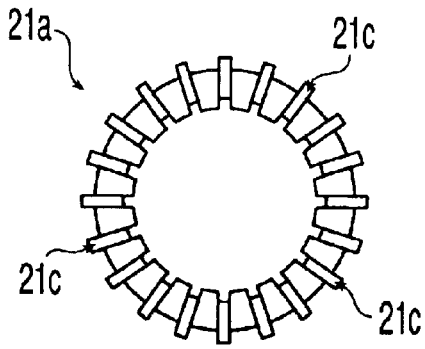
FIG. 1C shows a top view of the head portion of the projectile of FIG. 1B.

Projectile 20 preferably is formed of solid, hardened steel, however in alternate embodiments projectile 20 may be hollow and may be formed of other suitable materials as described with respect to tubular member 18. In one preferred exemplary embodiment, projectile 20 is generally spherical in shape. Advantageously, a spherical projectile 20 is symmetrical and thus orientation of projectile 20 is not important during assembly of system 10. However, any shape of projectile 20 that permits suitable expansion of tubular member 18 may be used. In an exemplary embodiment, projectile 20 has an outer diameter between about 0.75 inch and 1.5 inch; more preferably, projectile 20 has an outer diameter between about 1 inch and 1.375 inch. In alternate embodiments, as shown for example in FIG. 1A, a projectile 20*a* may instead be provided with a generally tapered head portion 21*a* (such as a conical shape) and a generally elongated body portion 21*b*, which may be integrally formed. In yet another alternate embodiment, shown in FIGS. 1B and 1C, tapered head portion 21*a* of projectile 20*a* may include linear projections 21*c* or splines disposed thereon for mechanically coupling projectile 20*a* to tubular member 18. Other shapes such as hemispheres also may be used for projectile 20.

In an exemplary embodiment, the inner diameter of tubular member 18 is between 70 and 97 percent of the outer diameter of projectile 20. More preferably, the inner diameter of tubular member 18 is between 85 and 97 percent of the outer diameter of projectile 20, and may be between 90 and 97 percent thereof.

Figure 2:
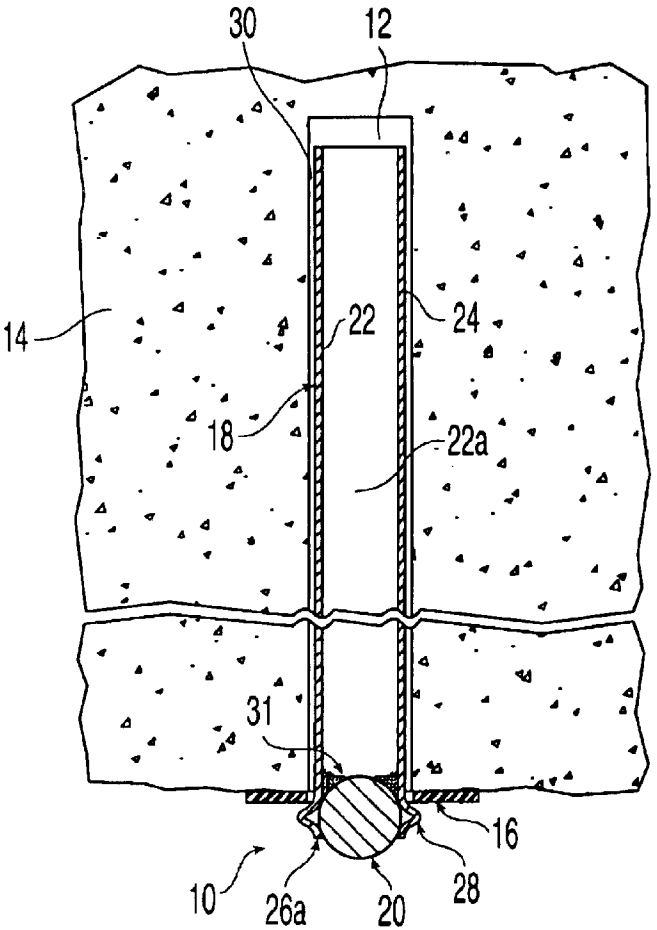
FIG. 2 shows a cross-sectional side view of the exemplary system of FIG. 1 with a tubular member inserted in the borehole prior to expansion of the tubular member.

Turning to FIG. 2, system 10 is shown prior to anchoring in rock 14. A borehole 12 is formed in rock 14, and bearing plate 16 is placed against rock 14 such that opening 16*a* is aligned with borehole 12 in rock 14. Tubular member 18 is inserted in opening 16*a* and borehole 12, so that enlarged end 28 of tubular member 18 abuts plate 16. As shown for example in FIG. 2, borehole 12 may extend along a first overall longitudinal length and tubular member 18 may be disposed in a portion of that length. In an exemplary preferred embodiment, a clearance of between 0 inch and 0.2 inch preferably is formed between the tubular member and borehole prior to expansion of the tubular member, and more preferably the clearance is between 0.01 inch and 0.1 inch. The clearance is selected so that tubular member 18 may be inserted in borehole 12 by hand or with a roof-bolting machine, as known in the art, and is also a function of the type of rock strata 14.

Projectile 20 is disposed proximate enlarged end 28 for insertion into opening 22*a*. Inner surface of tubular member 18 preferably defines an inner diameter or contour that is smaller the largest outer diameter of projectile 20. Thus, projectile 20 and tubular member 18 are configured and dimensioned so that when projectile 20 travels along the length of tubular member 18, at least a portion of projectile 20 has a greater width than opening 22*a*, so that the width of opening 22*a* may be expanded to at least frictionally engage surrounding rock 14.

A lubricant 31 may be disposed between projectile 20 and inner surface 22 of tubular member 18 to facilitate travel of projectile 20 by reducing friction. Lubricant 31 may be in the form of a coating on at least one of the projectile and the inner surface of the tubular member. In some embodiments, a lubricant is impregnated in projectile 20. For example, projectile 20 may be formed of a material that is oil-impregnated, such as oil-impregnated brass used to form bearings. In other embodiments, lubricant may be coated on a portion or all of inner surface 22. Suitable surface coatings include Teflon® (PTFE), galvanizing, and/or grease.

Figure 3:
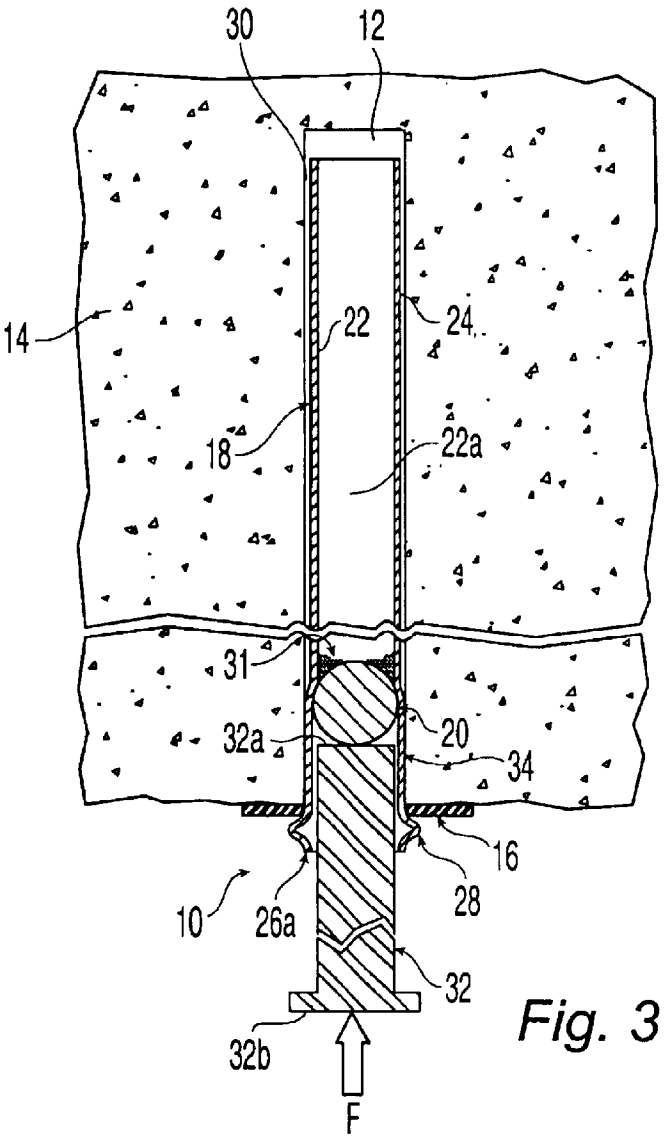
FIG. 3 shows a cross-sectional side view of the exemplary system of FIG. 1 with a partially expanded tubular member in the borehole.

As shown in FIG. 3, an insertion member 32 may be coaxially aligned with opening 22*a* in tubular member 18, with a distal end 32*a* thereof configured and dimensioned to abut projectile 20. Preferably, insert member 32 has an outer width less than the inner width defined by inner surface 22 of tubular member 18. In the preferred embodiment, distal end 32*a* is generally flat, but in alternate embodiments distal end 32*a* may be concave, convex, or otherwise shaped for engaging projectile 20. Proximal end 32*b* of insertion member 32 may be enlarged or otherwise configured and dimensioned to receive an external force F applied by a hammer or other device. In some embodiments, projectile 20 is integrally formed with insertion member 32, permitting reuse thereof in expanding multiple tubular members. As can be seen in FIG. 3, application of force F to projectile 20 causes projectile 20 to travel in opening 22*a* in tubular member 18. Inner surface 22 of tubular member 18 defines a first inner diameter or contour that is smaller than an outer diameter or contour of projectile 20. Thus when projectile 20 travels in opening 22*a*, tubular member 18 is mechanically expanded so that the outer surface or wall 24 thereof frictionally engages rock 14, as seen for example in region 34.

Figure 4:
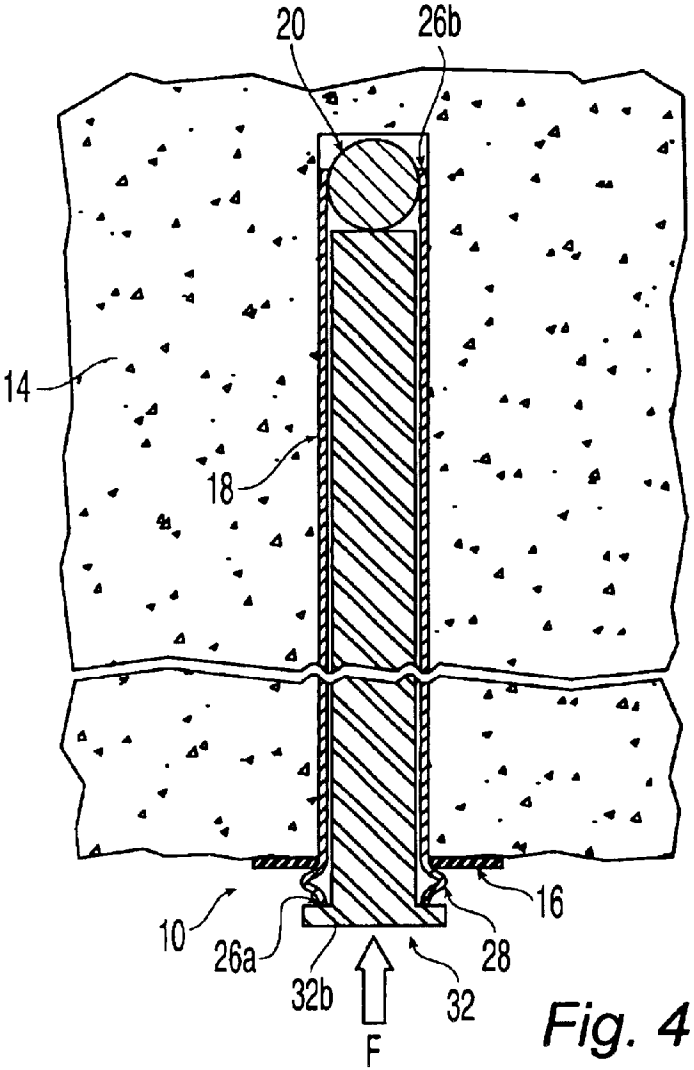
FIG. 4 shows a cross-sectional side view of the exemplary system of FIG. 1 with an expanded tubular member in the borehole and an insertion member disposed in the tubular member.
Figure 6:
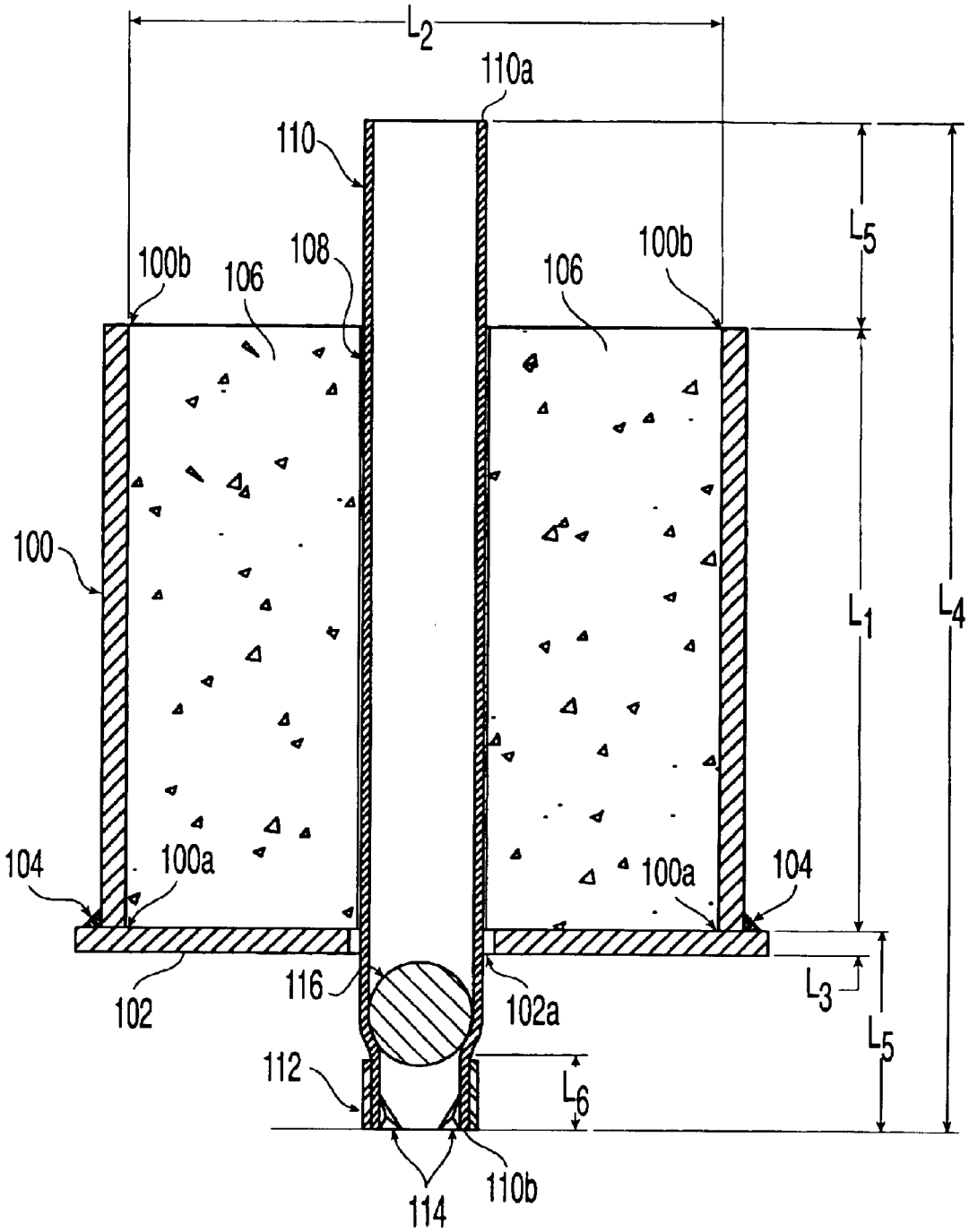
FIG. 6 shows a cross-sectional side view of a test apparatus.

Insertion member 32 preferably has a length along its longitudinal axis such that distal end 32*a* may travel substantially along the length of opening 22*a*, thereby permitting projectile 20 to travel and finally come to rest proximate second free end 26*b* of tubular member 18, where projectile 20 may seal opening 22*a* for example to provide corrosion resistance. Preferably, insertion member 32 has a length along its longitudinal axis that is selected so that when projectile 20 is disposed proximate second free end 26*b* of tubular member 18, the proximal end 32*b* of insertion member 32 abuts first free end 26*a* proximate enlarged portion 28. As shown in FIG. 4, substantially the entire opening 22*a* of tubular member 18 has been mechanically expanded by the passage of projectile 20 therein.

Figure 5:
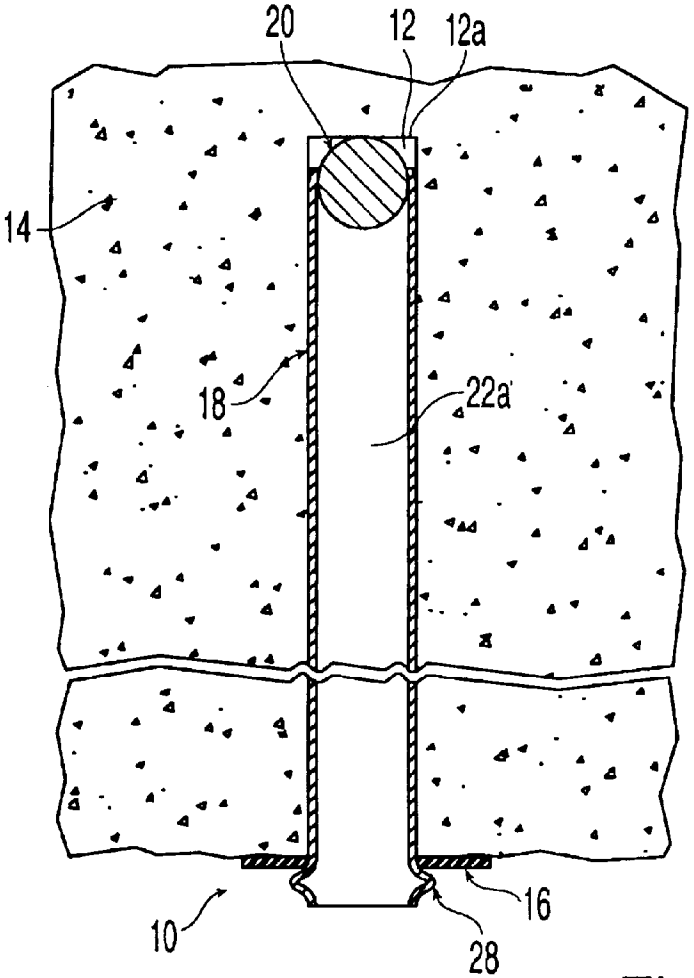
FIG. 5 shows a cross-sectional side view of the exemplary system of FIG. 1 with an expanded tubular member in the borehole.

Referring to FIG. 5, projectile 20 may travel within opening 22*a* such that projectile 20 comes to rest against an upper portion 12*a* of borehole 12 in rock 14. Insertion member 32 may then be removed therefrom. As a result of the expansion of tubular member 18, in an exemplary preferred embodiment, tubular member 18 frictionally engages rock 14 with an interfacial anchorage strength preferably between 100 psi and 1000 psi, and more preferably between 200 psi and 1000 psi. Also, a force that is preferably less than 20,000 pounds may be exerted on projectile 20 to force the projectile to travel in tubular member 18; more preferably, this force is between 3,000 pounds and 15,000 pounds, and most preferably the force is between 4,000 pounds and 10,000 pounds.

In a preferred method according to the present invention, borehole 12 is formed in rock 14, and bearing plate 16 is placed against rock 14 so that the opening 16*a* in bearing plate 16 is aligned with borehole 12. Tubular member 18 is inserted in borehole 12 and opening 16*a* so that enlarged end 28 of tubular member 18 abuts plate 16. Tubular member 18 is then mechanically expanded, for example with projectile 20, so that outer surface 24 frictionally engages rock 14. Preferably, borehole 12 is placed in radial compression and hoop tension in the region where tubular member 18 has been expanded. Such radial compression and hoop tension frictionally retain tubular member 18 in borehole 12 because the bulk modulus of elasticity of rock 14 is lower than the modulus of elasticity of tubular member 18. Advantageously, projectile 20 expands tubular member 18 against rock strata 14 and at the same time can effect firm contact between bearing plate 6 and rock strata 14. Tubular member 18 is placed in axial tension and adjacent rock strata 14 in compression by a force approximately equal to the force required to effect travel of projectile 20 in tubular member 18. Because of initial compression of rock strata 14, some resistance to movement of rock strata 14 is conferred.

Initially, projectile 20 may be disposed proximate enlarged end 28 of tubular member 18, and in order to force projectile 20 into tubular member 18, the projectile 20 may be pushed by insertion member 32. Projectile 20 may be forced through tubular member 18 to rest proximate free end 26*b* opposite enlarged end 28, and then insertion member 18 optionally may be removed from tubular member 18. Also, after expansion of tubular member 18, the projectile 20 optionally may be removed from tubular member 18. In addition, at least one of projectile 20 and inner surface 22 of tubular member 18 may be lubricated. Further, enlarged end 28 may be sealed. Tubular member 18 also may be mechanically coupled to rock 14, for example with projections such as small weld spatters disposed on outer surface 24.

As known in the art, a suitable mine roof bolting machine may be used to apply the force needed to propel projectile 20 in tubular member 18. Such machines typically are able to exert forces of at least 10,000 lbs. Alternatively, the necessary force may be exerted by a percussion hammer.

Experimentation was performed to determine the performance of tubular type frictional mining bolts such as those disclosed herein. To simulate the rock found in a mine roof, concrete was prepared using 3 parts limestone gravel, 2 parts silica sand, 1 part Portland cement, and suitable water to create a flowable mixture. The concrete was poured into a pipe 100 with a flange 102 coupled to an upper free end 100*a* thereof with a circumferential weld 104. Pipe 100 had a longitudinal length $L_1$ of about 6 inches (152 mm) and an inner diameter $L_2$ of about 6 inches. Flange 102 had a thickness $L_3$ of about ¼ inch (6 mm), and was provided with a central through hole 102*a* for receiving a tubular member, as will be described. Thus, the total longitudinal length of concrete section 106 was about the same as longitudinal length $L_1$ of pipe 100, or 6 inches (152 mm), with concrete section 106 extending to lower free end 100*b* of pipe 100.

To test boreholes 108 of different diameters, $D_B$, solid aluminum bars were machined to 1.260, 1.275, and 1.290 inch (32.0, 32.39, and 32.77 mm, respectively), and were centrally disposed in wet concrete section 106. Following curing of wet concrete section 106 for 4 hours, the aluminum bars were removed and concrete section 106 was permitted to cure for a minimum elapsed time of 14 days prior to testing.

Welded steel tube 110 with upper and lower ends 110*a*, 110*b*, respectively, was initially provided with an outer diameter of 1.255 inch (31.88 mm), a wall thickness of 0.093 inch (2.36 mm), and a length $L_4$ of 10 inches was used to simulate tubular type frictional mining bolts such as those disclosed herein. Tube 110 was disposed in borehole 108 such that a length $L_5$ of tube 110 of about two inches (51 mm) extended beyond each of free ends 100*a*, 100*b*. Central through hole 102*a* in flange 102 had a diameter of 1.375 inch, so that flange 102 would not interfere with expansion of tube 110. Lower end 100*b* of tube 110 was swaged along a length $L_6$ of about 0.75 inch, and a reinforcing collar 112 was coupled thereto. Additionally, a weld 114 was placed in the inside of tube 110 to partially close lower end 110*b*. The swaging and welding of lower end 110*b* ensured that a projectile 116 traveling from upper end 110*a* to lower end 110*b* could not exit tube 110 at lower end 110*b*. Performance testing was undertaken using a universal compression testing machine.

In a first "insertion force" test, a spacer (not shown) with a thickness of about 1.75 inch was placed under concrete section 106 and abutting flange 102 so that lower end 110*b* of tube 100 abutted a bottom platen of the universal compression testing machine. A spherical projectile 116 in the form of a steel ball having an outer diameter of 1.125 inch was forced into upper end 110*a* of tube 110 at a rate of about 0.1 inch/minute. Grease was provided between the surface of projectile 116 and the inner surface of tube 108 to facilitate movement of projectile 116 in tube 108. The grease was a multipurpose synthetic material with molybdenum-based additives. An insertion member (not shown) in the form of a steel bar having an outer diameter of 1 inch was aligned so that its central longitudinal axis was generally coaxial with the central longitudinal axis of tube 110; one end of the steel bar abutted a top platen of the universal compression testing machine, while the other end abutted projectile 116. The force $F_T$ required to push projectile 116 through the first two inches of tube 110 proximate upper, unconfined end 110*a* was first measured. Next, the force $F_C$ required to push projectile 116 through the section of tube 110 confined in concrete section 106 was measured as projectile 116 traveled toward lower end 110*b* under the force conferred by the insertion member. When projectile 116 reached the swaging at lower end 110*b*, the force applied by the universal compression testing machine was stopped.

In a second "anchorage strength" test, a spacer (not shown) with a thickness of about 2.75 inches was placed under concrete section 106 and abutting flange 102 so that a gap of about 1 inch was created between lower end 110*b* of tube 100 and the bottom platen of the universal compression testing machine. With projectile 116 disposed near the swaging at lower end 110*b*, and with grease provided as described above, a force was again applied by the universal compression testing machine. Initially, until projectile 116 reached the swaging at lower end 110*b*, the force was about the same as force $F_T$. When projectile 116 reached the swaging reinforced by collar 112 at lower end 110*b*, however, a sharp increase in force occurred and the maximum anchorage force $F_A$ was measured when tube 110 began to slip from concrete section 106.

Table I below lists exemplar test data:

TABLE I

| Test No. | Clearance (in.) | $D_B$ (in.) | $F_T$ (lbs.) | $F_C$ (lbs.) | $F_A$ (lbs.) |
|---|---|---|---|---|---|
| 1 | 0.005 | 1.260 | 3,000 | 6,200 | 27,000 |
| 2 | 0.005 | 1.260 | 3,500 | 7,500 | 22,000 |
| 3 | 0.020 | 1.275 | 3,500 | 6,500 | 23,000 |
| 4 | 0.020 | 1.275 | 3,500 | 5,500 | 18,000 |
| 5 | 0.035 | 1.290 | 3,200 | 4,300 | 1,500 |
| 6 | 0.035 | 1.290 | 3,500 | 5,200 | 21,000 |

As listed in Table I, forces $F_T$, $F_C$, and $F_A$ were the maximum such forces experienced during each test, while the listed clearance was the clearance between the outer surface of tube 110 and the wall of borehole 108. In addition, the force $F_T$ varied plus or minus about 500 lbs. during initial insertion of projectile 116.

During test number 6, the outer surface of tube 110 was roughened by providing approximately 200 small weld spatters (about 0.015 inches high and about 0.060 inches wide) thereon.

The measured outer diameter of tube 110 after travel of projectile 116 therein was 1.322 inches.

As a result of the tests described above, it was determined that the maximum anchorage force $F_A$ was quite high for all tested borehole/tube combinations except test number 5 which had a $D_B$ of 1.290 inches and a smooth outer surface of tube 110. It was also determined that it is desirable to have at least 20,000 lbs. strength per foot of anchorage, which was achieved in the testing with only 6 inches of contact between tube 110 and concrete section 106. Concomitantly, by roughening the outer surface of tube 110 as described above for test number 6, a dramatic improvement was realized in anchorage strength from 1,500 lbs. to 21,000 lbs. Finally, the required forces $F_T$, $F_C$ were reasonably small and well below the desired maximum of 10,000 lbs.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. For example, although an upset of flared proximal end 32*b* of insertion member 32 may be provided to provide suitable surface area to ensure sufficient contact with projectile 20, as has been described, in alternate embodiments such a head portion may not be necessary. For example, in some embodiments, projectile 20 may be pre-inserted and retained in tubular member 18, for example proximate flared portion 28. A user then may only need to use a tubular insertion member of smaller outer diameter than tubular member 18 to ram projectile 20. In addition, free end 26*a* of tubular member 18 proximate enlarged portion 28 may be sealed with a mechanical cap, or alternatively, the wall of tubular member 18 proximate free end 26*a* may include holes so that hooked objects may be hung therefrom. In yet another alternate embodiment, tubular member 18 may be provided without an enlarged portion 28, and an integrally formed projectile and insertion member may be inserted into tubular member 18. In such a case, a flared proximal end 32*b* of insertion member 32 may be provided to abut bearing plate 16 to retain plate 16 against rock 14. The system also includes a projectile and an insertion member Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A method for inserting a bolt in rock comprising:

forming a borehole in rock;

placing a bearing plate with an opening therein against the rock so that the opening is aligned with the borehole;

disposing a tubular member in the borehole and opening so that an enlarged end of the tubular member abuts an exposed surface of the plate;

capturing a projectile in a flared portion of the enlarged end;

mechanically and plastically expanding a circumference of the tubular member by driving the projectile starting proximate the enlarged end and along a substantial length of the tubular member so that an outer wall thereof frictionally engages the rock;

progressively placing the tubular member in axial tension when the outer wall thereof frictionally engages the rock.

2. The method of claim 1, wherein the tubular member has a modulus of elasticity that is greater than a bulk modulus of elasticity of the rock.

3. The method of claim 1, wherein the tubular member frictionally engages the rock with an interfacial anchorage strength of between 100 psi and 1000 psi.

4. The method of claim 1, wherein the tubular member frictionally engages the rock with an anchorage strength of between 200 psi and 1000 psi.

5. The method of claim 1, wherein the tubular member is mechanically expanded by forcing a projectile against an internal wall of the tubular member.

6. The method of claim 5, wherein a force of less than 20,000 pounds is exerted on the projectile to force the projectile to travel in the tubular member.

7. The method of claim 5, wherein a force of between 3,000 pounds and 15,000 pounds is exerted on the projectile to force the projectile to travel in the tubular member.

8. The method of claim 5, wherein a force of between 4,000 pounds and 10,000 pounds is exerted on the projectile to force the projectile to travel in the tubular member.

9. The method of claim 5, wherein the projectile is generally spherical.

10. The method of claim 5, wherein the projectile has a generally tapered bead portion and a generally elongated body portion.

11. The method of claim 5, further comprising:

removing the projectile from the tubular member after expansion thereof.

12. The method of claim 5, wherein the borehole has a first length and the tubular member is disposed in a portion of the first length.

13. The method of claim 5, further comprising:

disposing a projectile proximate the enlarged end of the tubular member;

contacting the projectile with an insertion member;

inserting the insertion member into the tubular member to force the projectile into the tubular member.

14. The method of claim 13, further comprising:

forcing the projectile proximate a free end of the tubular member opposite the enlarged end.

15. The method of claim 13, further comprising:

removing the insertion member from the tubular member.

16. The method of claim 5, further comprising:

lubricating at least one of the projectile and internal wall of the tubular member.

17. The method of claim 5, further comprising:

closing the enlarged end of the tubular member.

18. The method of claim 1, further comprising:

mechanically coupling the tubular member to the rock.

19. The method of claim 1, wherein the tubular member is mechanically coupled to the rock by forcing a protruding portion of the tubular member into the rock.

20. The method of claim 1, wherein the tubular member is mechanically coupled to the rock by a deformable layer disposed on the outer wall.

21. The method of claim 20, wherein the deformable layer comprises sprayed metal.

22. The method of claim 20, wherein the deformable layer comprises a polymer.

23. The method of claim 1, wherein a clearance of between 0 inch and 0.2 inch is formed between the tubular member and borehole prior to expansion of the tubular member.

24. The method of claim 1, wherein a clearance of between 0.01 inch and 0.1 inch is formed between the tubular member and borehole prior to expansion of the tubular member.

25. A system for mine roof reinforcement comprising:

a bearing plate having a mine roof engagement surface and an exposed surface;

a tubular member with an inner surface, an outer surface, first and second free ends, and an enlarged portion disposed proximate one of the free ends and abutting the exposed surface of the bearing plate;

a projectile captured in a flared portion of the enlarged end and moveable in the tubular member between the free ends; and an insertion member for being received in the tubular member;

wherein the tubular member is sized to accommodate the projectile therein by interference fit substantially between the ends, and wherein the projectile is sized to place the tubular member in axial tension substantially between the ends when the outer surface thereof frictionally engages rock.

26. The system of claim 25, wherein the projectile is generally spherical.

27. The system of claim 25, wherein the projectile and insertion member are integrally formed.

28. The system of claim 27, wherein the projectile is generally tapered and the insertion member is generally elongated.

29. The system of claim 25, wherein the inner surface of the tubular member defines a first inner diameter that is smaller than an outer diameter of the projectile.

30. The system of claim 25, wherein the inner surface of the tubular member defines a first inner contour that is smaller than an outer contour of the projectile.

31. The system of claim 25, wherein the outer surface of the tubular member is textured.

32. The system of claim 25, wherein the outer surface of the tubular member has protrusions thereon.

33. The system of claim 25, wherein the outer surface of the tubular member is coated with a polymer.

34. The system of claim 33, wherein the outer surface of the tubular member is coated with an elastomer.

35. The system of claim 25, wherein the outer surface of the tubular member is coated with a roughening agent.

36. The system of claim 25, wherein the outer surface of the tubular member has a fiber-reinforced polymer thereon.

37. The system of claim 25, wherein at least one of the projectile and the inner surface of the tubular member are coated with a lubricant.

38. The system of claim 25, wherein a lubricant is impregnated in the projectile.

39. The system of claim 25, wherein the tubular member is formed of steel.

40. The system of claim 25, wherein the projectile has a diameter between about 0.75 inch and 1.5 inch.

41. The system of claim 25, wherein the projectile has a diameter between about 1 inch and 1.375 inch.

42. The system of claim 25, wherein the inner diameter of the tubular member is between 70 and 97 percent of the outer diameter of the projectile.

43. The system of claim 25, wherein the inner diameter of the tubular member is between 85 and 97 percent of the outer diameter of the projectile.

44. The system of claim 25, wherein the inner diameter of the tubular member is between 90 and 97 percent of the outer diameter of the projectile.

45. The system of claim 25, wherein the tubular member has a substantially uniform outer diameter.

46. The system of claim 25, wherein the outer surface of the tubular member has a substantially circular cross-section.

47. The system of claim 25, wherein the tubular member has at least one generally linear projection extending along the inner surface between the free ends.

48. The system of claim 47, wherein at least one projection comprises a weld line.

* * * * *

UNITED STATES PATENT AND TRADEMARK OFFICE

CERTIFICATE OF CORRECTION

PATENT NO. : 6,935,811 B2
DATED : August 30, 2005
INVENTOR(S) : Simmons et al.

It is certified that error appears in the above-identified patent and that said Letters Patent is hereby corrected as shown below:

Column 9,
Line 53, change “bead” to -- head --; and

Column 10,
Line 47, change “,” to -- ; --.

Signed and Sealed this

First Day of November, 2005

JON W. DUDAS
*Director of the United States Patent and Trademark Office*